US005264114A

United States Patent [19]

Dunbar

[11] Patent Number: 5,264,114

[45] Date of Patent: Nov. 23, 1993

[54] HYDROCARBON TREATING PROCESS

[75] Inventor: Fred A. Dunbar, Lake Jackson, Tex.

[73] Assignee: Phillips Petroleum Company, Bartlesville, Okla.

[21] Appl. No.: 673,996

[22] Filed: Mar. 25, 1991

[51] Int. Cl.[5] ..... C10G 9/12

[52] U.S. Cl. ..... 208/48 HA; 208/48 R; 208/48 Q; 208/289; 585/950; 585/650; 423/245.2; 423/228; 423/220

[58] Field of Search ..... 585/650, 950; 208/48 AA, 48 Q, 289; 423/245.2, 228, 220; 213/7; 55/68

[56] References Cited

U.S. PATENT DOCUMENTS

| | | | |
|---|---|---|---|
| 2,460,056 | 1/1949 | Yowell | 423/245.2 |
| 2,899,475 | 8/1959 | Davidson | 585/650 |
| 3,682,779 | 8/1972 | Ritter et al. | 203/7 |
| 3,696,162 | 10/1972 | Kniel | 423/229 |
| 3,793,187 | 2/1974 | Marx et al. | 208/289 |
| 4,107,030 | 8/1978 | Slovinsky et al. | 208/48 |
| 4,158,045 | 6/1979 | Schaffer et al. | 423/245.2 |
| 4,556,476 | 12/1985 | Miller | 585/950 |
| 4,569,750 | 2/1986 | Brownawell | 585/950 |
| 4,673,489 | 6/1987 | Rolling | 208/289 |
| 4,804,456 | 2/1989 | Forester | 208/48 |
| 4,835,338 | 5/1989 | Liu | 585/823 |
| 4,952,301 | 8/1990 | Awbry | 208/48 A |

*Primary Examiner*—Helane Myers
*Attorney, Agent, or Firm*—Charles W. Stewart

[57] ABSTRACT

Cracked hydrocarbon gases are treated to remove contaminating compounds that react in caustic wash to form the reaction products which cause equipment fouling. The treating of the cracked hydrocarbon gases includes the contacting of a cracked hydrocarbon stream with an aqueous amine solution, prior to caustic washing, to remove carbonyl compounds contained in the cracked hydrocarbon gases. By treating the cracked hydrocarbons with an amine compound prior to caustic washing, the formation and deposition of fouling compounds upon the internal components of caustic treating equipment is inhibited.

28 Claims, 1 Drawing Sheet

HYDROCARBON TREATING PROCESS

This invention relates to the treatment of hydrocarbons or hydrocarbon mixtures to remove contaminants therefrom. More specifically, this invention relates to the minimization of fouling in hydrocarbon treating equipment by the removal of carbonyl compounds from hydrocarbons or hydrocarbon mixtures.

In a process for producing olefin compounds, a hydrocarbon feed stream, which can comprise primarily hydrocarbons selected from the group consisting of ethane, propane, butane, pentane, naphtha and mixtures of any two or more thereof, is fed into a pyrolytic cracking furnance. Within the cracking furnace, the feed material is converted into a gaseous product mixture. If the feed stream is a hydrocarbon mixture, pyrolytic cracking takes place whereby the hydrocarbons are converted into olefin compounds such as ethylene, propylene, butylene, and amylene. As a result of the pyrolytic cracking of hydrocarbons, the cracked product stream can also contain significant quantities of hydrogen, carbon monoxide, carbon dioxide, and other pyrolytic reaction products besides olefin compounds. To improve the equilibrium reaction conditions within the pyrolytic cracking furnace, it is sometimes desirable to add a diluent stream to the pyrolytic cracking furnace feed stream.

The cracked hydrocarbon product is cooled, which allows for the removal of most of the heavier hydrocarbon gases, followed by compression and then caustic treating or washing to remove contaminating acidic compounds. The source of the acidic components can come both from substances contained within the hydrocarbon feed to the cracking furnace and from reaction products of the cracking reaction.

A problem which is often encountered in the caustic washing of the cracked hydrocarbon gases is the formation of fouling deposits upon the surfaces of the internal parts of the caustic treating vessels. These deposits have the negative results of restricting flow through the contacting equipment, such as contacting trays, and causing inefficient contact between the cracked hydrocarbons and the caustic. As the flow of the cracked hydrocarbons through the caustic treating vessel is restricted, the pressure drop is increased across the treating vessel so as to cause a loss of capacity and to increase the cost of operating the treating vessel. Eventually, the deposition of fouling components on the caustic treating vessel internals can result in the premature shutdown of a cracking operation.

While the precise mechanism of the fouling process within the caustic treating vessel is not known with certainty, it appears that the fouling deposits accumulated within the caustic treating vessel are a result of aldol-condensation reactions whereby small amounts of the carbonyl compounds, which are generated as by-products of the pyrolytic cracking reactions, react to form certain aldol compounds. The conditions within the caustic treating vessel are suitable for promoting the aldol-condensation reaction because of the presence of a dilute caustic that serves as a catalyst for catalyzing the reaction. The aldols formed are esentially insoluble in the caustic solution and, therefore, deposit upon the internal surfaces of the caustic treating vessel.

It is thus an object of this invention to provide an improved process for treating cracked hydrocarbons.

Another object of this invention is to provide an improved process for minimizing the formation and deposition of fouling compounds during the caustic washing of cracked hydrocarbons.

A still further object of this invention is to provide an improved process for inhib iting the formation and deposition of fouling materials during the caustic washing of hydrocarbon gases that are contaminated with carbonyl compounds.

A yet further object of this invention is to provide an improved process for lowering the operating cost of treating cracked hydrocarbons.

In accordance with the invention, a method for inhibiting the formation and deposition of fouling materials during a caustic washing of hydrocarbon gases that are contaminated with carbonyl compounds is provided wherein the hydrocarbon gases are treated with an aqueous amine solution prior to the caustic washing of the hydrocarbon gases. During this treating step a significant amount of the carbonyl compounds are removed. A further embodiment of this invention includes a process for treating cracked hydrocarbons produced by the pyrolytic cracking of other hydrocarbons and having contaminating amounts of carbonyl compounds and contaminating amounts of acidic compounds. This process comprises contacting cracked hydrocarbons with a quench solution within quench means. The quench solution contains a sufficient concentration of an amine compound for removing certain contaminating quantities of carbonyl compounds contained within the cracked hydrocarbons. An additional embodiment of this invention comprises an ethylene cracking process wherein a hydrocarbon stream is charged to pyrolytic cracking furnace means to produce a cracked hydrocarbon stream followed by passing the cracked hydrocarbon stream to quench means for treatment to remove contaminants followed by passing the thus treated hydrocarbon stream to caustic wash means to further remove contaminants. In quench means the cracked hydrocarbon stream is contacted with a quench stream that has a sufficient concentration of an amine compound suitable for removing a significant quantity of contaminants contained within the cracked hydrocarbon stream.

Other objects and advantages of the invention will be apparent from the description of the invention and the appended claims thereto as well as from the detailed description of the drawing in which:

Figure 1:
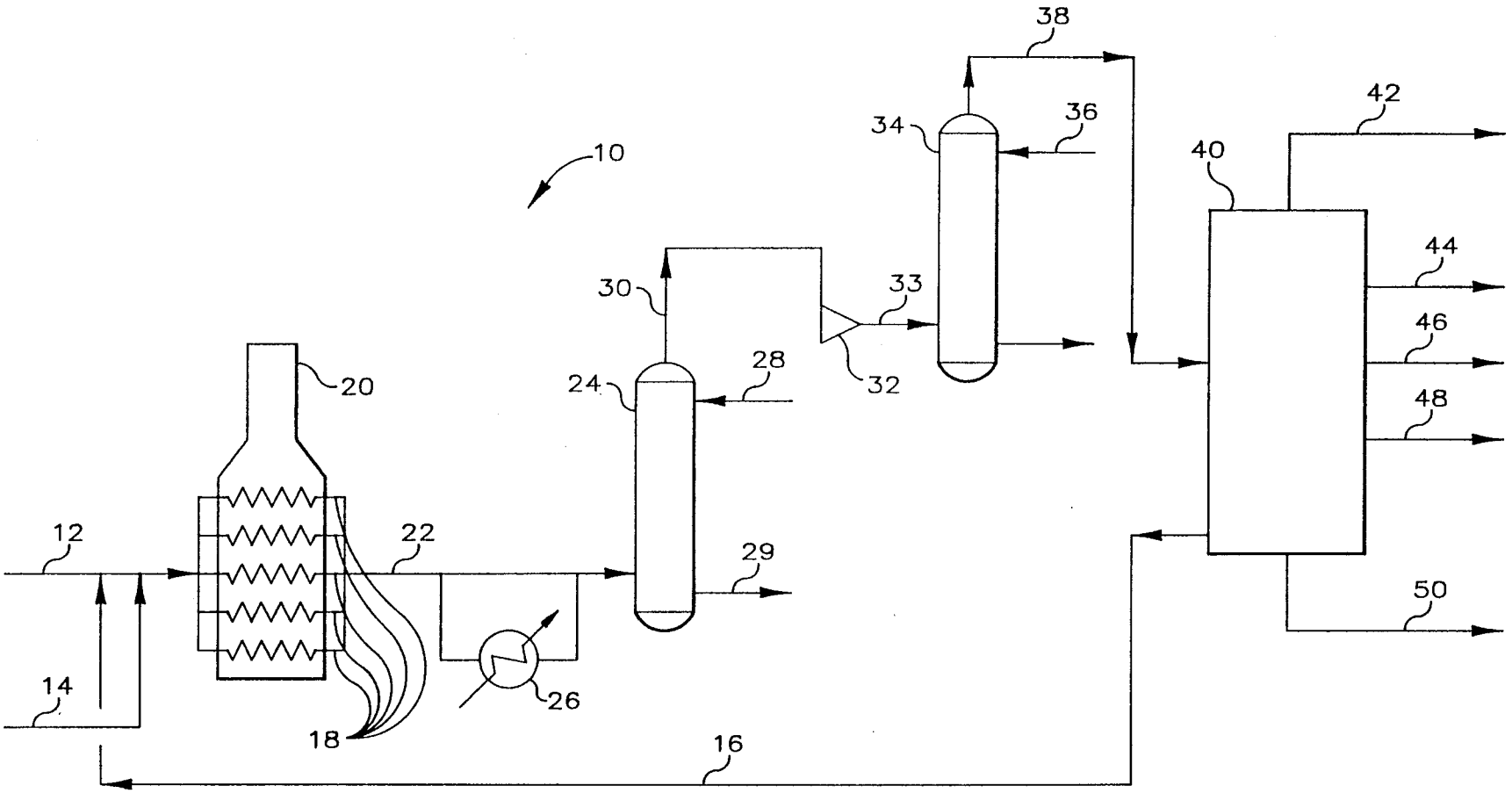
FIG. 1 is a schematic diagram representing the portion of an ethylene cracking process that includes pyrolytic cracking furnace means, quench tower means, caustic treating means and further downstream processing.

The process of this invention involves the pyrolytic cracking of hydrocarbons to produce desirable hydrocarbon end-products. A hydrocarbon stream is fed or charged to pyrolytic cracking furnace means wherein the hydrocarbon stream is subjected to a severe, high-temperature environment to produce cracked gases. The hydrocarbon stream can comprise any type of hydrocarbon that is suitable for pyrolytic cracking to olefin compounds. Preferably, however, the hydrocarbon stream can comprise paraffin hydrocarbons selected from the group consisting of ethane, propane, butane, pentane, naphtha, and mixtures of any two or more thereof. Naphtha can generally be described as a complex hydrocarbon mixture having a boiling range of from about 180° F. to about 400° F. as determined by the standard testing methods of the American Society of Testing Materials (ASTM). Depending upon the source of the feed stock material charged to pyrolytic cracking furnace means, the hydrocarbon feed stream can contain contaminating amounts of acidic compounds. These acidic compounds can comprise substances selected from a group consisting of hydrogen sulfide, carbon dioxide, carbon monoxide, and mixtures of any two or more thereof.

As an optional feature of the invention, the hydrocarbon feed being charged to pyrolytic cracking furnace means can be intimately mixed with a diluent prior to entering pyrolytic cracking furnace means. This diluent can serve several positive functions, one of which includes providing desirable reaction conditions within pyrolytic cracking furnace means for producing the desired reactant end-products. The diluent does this by providing for a lower partial pressure of hydrocarbon feed fluid thereby enhancing the cracking reactions necessary for obtaining the desired olefin products while reducing the amount of undesirable reaction products such as hydrogen and methane. Also, the lower partial pressure resulting from the mixture of the diluent fluid helps in minimizing the amount of coke deposits that form on the furnace tubes. While any suitable diluent fluid that provides these benefits can be used, the preferred diluent fluid is steam.

The cracking reactions induced by pyrolytic cracking furnace means can take place at any suitable temperature that will provide the necessary cracking to the desirable end-products. The actual cracking temperature utilized will depend upon the composition of the hydrocarbon feed stream. Generally, the cracking temperature can run upwardly to 1700° F. or greater depending upon the amount of cracking desired. Most preferably, however, the cracking temperature will be in the range of from about 1550° F. to about 1670° F.

The cracked hydrocarbon effluent or cracked hydrocarbons or cracked hydrocarbon stream from pyrolytic cracking furnace means will generally be a mixture of hydrocarbons in the gaseous phase. This mixture of gaseous hydrocarbons will not only comprise the desirable olefin compounds, such as ethylene, propylene, butylene, and amylene, but also, this cracked hydrocarbon stream will contain undesirable contaminating components that include both oxygenated compounds and acidic compounds. The contaminating acidic compounds, which include both those compounds which entered the process with the hydrocarbon feed stream and those compounds created as a result of pyrolytic cracking reactions, include such compounds selected from a group consisting of hydrogen sulfide, carbon dioxide, carbon monoxide and mixtures of any two or more thereof. Generally, the amount of contaminating acidic compounds produced by the pyrolytic cracking of a hydrocarbon feed can range from about 200 parts per million (ppm) to about 1000 ppm. These contaminating compounds must be significantly removed so as to have a final end-product which meets product specifications.

As for the oxygenated compounds, it has been found that their presence in a cracked hydrocarbon stream during the caustic washing of said stream to remove the contaminating amounts of acidic compounds create extreme and undesirable fouling of the internal parts and mechanical components of caustic wash means. It is theorized that the mechanism by which this fouling takes place is by the aldol-condensation reaction. Under this mechanism, the oxygenate compounds contained within the cracked hydrocarbon stream react with each other within caustic wash means to produce aldol compounds which form deposits upon the internal surfaces of caustic wash means. This aldol condensation reaction is presumed to be catalyzed by the caustic material, or base material, used in caustic wash means to remove the contaminating acidic compounds. The oxygenated compounds formed in the pyrolytic reaction can be any type of compound that contains an oxygen atom; however, the process of this invention is most effective where the oxygenated compound contains the carbonyl group, represented by the formula C=O, and that is herein referred to as carbonyl compounds. More specifically, this invention is believed to be most effective when the contaminating carbonyl compounds are selected from a group consisting of aldehydes, ketones and mixtures thereof. Generally, the concentration of contaminating carbonyl compounds in a cracked hydrocarbon stream will range from about 5 ppm to about 40 ppm.

The cracked hydrocarbon effluent gases from pyrolytic cracking furnace means is cooled by any suitable method of heat exchange to a temperature in the range of from about ambient temperature to about 400° F. The thus cooled cracked hydrocarbon stream is fed to quench means wherein the cooled cracked hydrocarbon stream is contacted with a quench solution having a sufficient concentration of an amine compound for removing a significant quantity of the carbonyl compounds contained within the cracked hydrocarbon stream. Preferably, the amounts of carbonyl compounds removed from the cracked hydrocarbon stream will be such that the concentration of carbonyl compounds is reduced to less than 500 ppm and, most preferably, to the concentration range of from 0.5 ppm to 500 ppm.

Quench means can be any suitable device for contacting the cracked hydrocarbon stream with the quench solution. Such suitable quench means can include, but not be limited to, plate columns, packed columns, and spray chambers. These contact means are illustrated and described at length in *Perry's Chemical Engineers, Handbook*, chapter 18 (Green, 6th ed., 1984). The contacting of the two liquids can take place by countercurrent flow, cocurrent flow, or crossflow or any combination of two or more flow types. Preferably, quench means utilizes a vessel having a combination of internal contacting means with such means including at least one plate disperser, at least one baffle tray, and a spray chamber wherein the cracked hydrocarbon stream is contacted with a spray of the quench solution. The preferred flow as herein described is in a countercurrent fashion with the cracked hydrocarbon stream entering the lower portion of quench means, passing upwardly and exiting from the upper portion of quench means. The quench solution is fed to the upper portion of quench means and flows in a countercurrent fashion to that of the cracked hydrocarbon stream into the lower portion of quench means from which it is removed for further processing.

The quench solution used for contacting with the cracked hydrocarbon stream can be any suitable liquid that can provide the desired heat transfer from the hot cracked hydrocarbon stream to the quench solution. Other physical properties that are necessary for a suitable quench solution are that it be immiscible with hydrocarbons and that amine compounds are soluble therein. The preferred quench solution is water.

To provide the necessary removal of carbonyl compounds from the cracked hydrocarbon stream, the quench solution fed to quench means is to have a sufficient concentration of an amine compound suitable for removing a significant quantity of carbonyl compounds contained in the cracked hydrocarbon stream. The amine compound is added to the quench solution so as to give a concentration in the range of from about 2 ppm to about 5,000 ppm. Preferably, the concentration of amine compound in the quench solution will range from about 10 ppm to about 200 ppm.

It is believed that the mechanism which takes place within quench means, which provides for the removal of contaminating amounts of carbonyl compounds, involves the reaction of either ketones or aldehydes, or both, with either a primary amine compound or a secondary amine compound to form an imine compound or an enamine compound, or both, that are soluble in water. By reacting the carbonyl compounds with these amine compounds to form imine or enamine compounds, the carbonyl compounds are removed from the cracked hydrocarbon stream due to the solubility of such reactant compounds in the quench solution.

It has been found that slightly acidic contact conditions can improve the reaction of the contaminating carbonyl compounds with the amine compounds. One preferred method for providing acidic contacting conditions is to add a buffering agent or a pH-modifying substance to the quench solution to maintain an appropriate pH necessary for the optimum removal of carbonyl compounds from the cracked hydrocarbon stream. Generally, the pH of the quench solution should be maintained in the range from about 4.5 to about 7.0; however, in the case where the cracked hydrocarbon stream contains significant amounts of acidic compounds, the amount of the buffering agent added to the quench solution should be adjusted in response to the concentration of these acidic compounds in the cracked hydrocarbon stream being fed to quench means. For example, if the cracked hydrocarbon stream contains significant quantities of the acidic compounds of hydrogen sulfide and carbon dioxide, the quench solution will have a pH closer to neutral or perhaps even greater than neutral. But, on the other hand, if the cracked hydrocarbon stream contains a low concentration of contaminating acidic compounds, the pH of the quench solution will be maintained in the range of from about 4.5 to about 7.0.

The buffering agent can be any suitable substance for adjusting the pH of a solution. Such substances can include strong or weak acids and strong or weak bases depending upon the pH desired. Preferably, an acid substance will be required for modifying the pH of the quench solution with the most preferred acid being either hydrochloric acid or sulfuric acid.

The treated and cooled cracked hydrocarbon stream exits quench means and passes to caustic wash means wherein the treated hydrocarbon stream is contacted with a caustic stream to thereby remove a significant portion of the acidic compounds contained within the cracked hydrocarbon stream. Any suitable method or means for contacting the treated cracked hydrocarbon stream with a caustic solution can be used. Such suitable contacting means are illustrated and described at length in *Perry's Chemical Engineers' Handbook*, Chapter 18, (Green, 6th ed., 1984). The various contacting means can include plate columns of either the cross-flow type plates or the counter-flow type plates, packed columns utilizing any of the various types of packing elements; or spray type contactors. It is preferred to use, however, plate-type columns for the gas-liquid contacting. The mode of flow within caustic wash means can be either cross-flow or countercurrent flow, or both, but the preferred mode of flow is cross-flow because of transfer-efficiency advantages and greater operating range.

A caustic stream is introduced into the upper portion of caustic wash means and the treated cracked hydrocarbon stream is introduced into its lower portion. The caustic introduced into caustic wash means flows downwardly through the vessel while the treated cracked hydrocarbons flow upwardly through caustic wash means whereby the treated, cracked hydrocarbons are intimately contacted with the caustic. The trays within caustic wash means provide for an intimate contacting of the treated, cracked hydrocarbon gases and the caustic. As a result of this intimate contact, a significant portion of the contaminating acidic compounds is removed from the hydrocarbons as the caustic solution contacts the cracked hydrocarbons. It is preferred that substantially all the contaminating acidic compounds be removed from the treated cracked hydrocarbon stream or, at least, the concentration of such acidic compounds be reduced to levels which are non-contaminating. Most preferably, the concentration of such acidic compounds shall be less than 5 ppm. As the caustic flows downwardly with caustic wash means it accumulates in the lower portion of caustic wash means wherefrom it is removed for further processing.

Problems which are often experienced in the operation of caustic wash means are the formation and deposition of fouling materials during the caustic washing or treatment of hydrocarbons containing carbonyl compounds. In many instances, aldol condensation reactions produce polymeric materials which deposit on the equipment within caustic wash means that leads to fouling and the eventual plugging of the trays. To alleviate this problem, the cracked hydrocarbon stream is treated prior to entering caustic wash means so as to remove carbonyl compounds prior to their contact with caustic materials.

Referring now to FIG. 1, there is provided a generalized flow scheme of an ethylene cracking unit 10. In ethylene cracking unit 10, a hydrocarbon feedstream 12 is combined and mixed with diluent stream 14 and recycle stream 16 and charged to at least one cracking tube 18 of pyrolytic cracking furnace means 20. Although any suitable diluent fluid acceptable for use in the at least one cracking tube 18 can be used, the diluent fluid preferred for use in this process is steam.

Pyrolytic cracking furnace means 20 is the primary source for providing the necessary heat energy for cracking the paraffin hydrocarbons contained within hydrocarbon feedstream 12. Generally, the paraffins of hydrocarbon feedstream 12 are heated to a temperature in the range upwardly to about 1700° F. in order to promote the desired cracking reactions. Most preferably, however, the cracking temperature will be in the range of from about 1550° F. to about 1670° F.

The material exiting the at least one cracking tube 18 of pyrolytic cracking furnace means 20 are the cracked hydrocarbons or hydrocarbon gases of cracked hydrocarbon stream 22. As a result of the cracking reactions that take place within the at least one cracking tube 18, contaminating amounts of carbonyl compounds and contaminating amounts of acidic compounds can be produced. These contaminants are contained within the cracked hydrocarbon stream 22 that is introduced or passes into quench means 24. Within quench means 24, the cracked hydrocarbons are both cooled and treated to remove contaminating amounts of carbonyl compounds. As an optional step in the process, cracked hydrocarbon stream 22 can be cooled by indirect heat exchange means 26 prior to being fed to quench means 24. Generally, cracked hydrocarbon stream 22 is fed to quench means 24 at a temperature in the range of from about 300° F. to about 400° F.

Introduced into quench means 24 in substantially countercurrent flow to that of the cracked hydrocarbons of cracked hydrocarbon stream 22 is quench stream 28. Quench stream 28 can comprise any suitable quench solution for providing sufficient heat removal from the cracked hydrocarbon stream 22 and which provides sufficient removal of contaminating amounts of carbonyl compounds within cracked hydrocarbon stream 22. Preferably, however, the quench solution comprises water and an amine compound in the concentration range of from about 2 ppm to about 500 ppm and, most preferably, the amine compound should be present in the range of from about 10 ppm to about 200 ppm. For optimum removal of contaminating amounts of carbonyl compounds from the cracked hydrocarbon stream 22, it is sometimes necessary to buffer quench stream 28 with a pH-modifying substance. The optimum pH of quench stream 28 will be a function of the concentration of the contaminating acidic compounds contained within cracked hydrocarbon stream 22. It is therefore necessary to adjust the pH of quench stream 28 in response to the changes in the concentration of the contaminating acidic compounds in cracked hydrocarbon stream 22. In the case where the concentration of contaminating acidic compounds in cracked hydrocarbon 22 is insignificant, the preferred pH range of quench stream 28 is from about 4.5 to about 7.0. To achieve this pH range, it is generally required to add an acidic compound to quench stream 28 in order to lower its pH. Any suitable acid compound can be used for adjusting the pH of quench stream 28. Preferably, the acid used is selected from the group consisting of hydrochloric acid and sulfuric acid. The previously contacted quench solution containing the contaminants or contaminant reaction product is removed from quench means 24 via stream 29.

An essentially carbonyl-free, quenched hydrocarbon stream or treated hydrocarbon stream 30 exits quench means 24 and is compressed by compressor means 32 with the compressed treated hydrocarbon stream 33 passing to caustic wash means 34. Within caustic wash means 34, treated hydrocarbon stream 30 is contacted with a caustic stream 36 in a generally countercurrent flow mode. Any suitable caustic material can be used for removing contaminating amounts of acidic compounds from treated hydrocarbon stream 30. The preferred caustic material is sodium hydroxide.

The finally treated hydrocarbon stream 38 exits caustic wash means 34 and passes to separation system 40. Separation system 40 provides for the separation of the olefin hydrocarbons, methane and lighter compounds, and a substantial portion of the unconverted paraffins. The separated unconverted paraffin hydrocarbons are returned to be mixed with hydrocarbon feedstream 12 via recycle stream 16. The remaining components of finally treated hydrocarbon stream 38 are segregated into fuel stream 42, ethylene stream 44, propylene stream 46, butylene stream 48, and amylene stream 50 for further downstream uses.

The invention as herein described provides for the improvement in the operation of a hydrocarbon pyrolytic cracking process by treating cracked hydrocarbons in a manner which removes contaminants that cause fouling materials to form and to deposit upon the internal parts of certain caustic treating vessels or washing vessels. By utilizing a concentration of an amine compound in a quench solution that is contacted with cracked hydrocarbons prior to the cracked hydrocarbons being treated with a caustic wash solution, fouling precursors are removed thereby minimizing or reducing the amount of fouling which occurs in the caustic washing vessels. The minimization of fouling of the internal components of these caustic washing vessels results in greater cracked gas throughput, less frequent downtime, and lower hydrocarbon pyrolytic cracking operating cost.

While this invention has been described in detail for purposes of illustration, it is not to be construed as limited thereby but is intended to include all reasonable variations and modifications within the scope and spirit of the described invention and the appended claims.

That which is claimed is:

1. A method for inhibiting the formation and deposition of fouling materials during caustic washing of hydrocarbon gases contaminated with carbonyl compounds which comprises:

treating said hydrocarbon gases with an aqueous amine solution, wherein said aqueous amine solution comprises water and an amine compound having a concentration range of from about 2 ppm to about 5,000 ppm, and wherein the amine of said aqueous amine solution is selected from the group of organic compounds consisting of the formula $RNH_2$ and $R_2NH$ wherein R is selected from the group consisting of alkyl groups and aryl groups, prior to said caustic washing, to remove a significant amount of said carbonyl compounds and to thereby produce a treated hydrocarbon stream.

2. A method according to claim 1 wherein said hydrocarbon gases are produced by the pyrolytic cracking of other hydrocarbons.

3. A method according to claim 2 wherein said hydrocarbon gases are produced by the pyrolytic cracking of other hydrocarbons selected from a group consisting of ethane, propane, butane, pentane, naphtha and mixtures of of any two or more thereof.

4. A method according to claim 3 wherein said carbonyl compounds are selected from a group consisting of aldehydes, ketones, and mixtures thereof.

5. A method according to claim 4 wherein said carbonyl compounds are present in said hydrocarbon gases in the concentration range of from about 1 ppm to about 1,000 ppm and wherein said treated hydrocarbon stream contains carbonyl compounds in the concentration range of from about 0.5 ppm to about 500 ppm.

6. A method according to claim 5 wherein said aqueous amine solution is buffered witha pH-modifying substance in an amount sufficient to adjust the pH of said aqueous amine solution to the range of from about 4.5 to about 7.0.

7. A process for treating cracked hydrocarbons produced by the pyrolytic cracking of other hydrocarbons and having contaminating amounts of carbonyl compounds and contaminating amounts of acidic compounds which comprises:

charging said cracked hydrocarbons to quench means wherein said cracked hydrocarbons are contacted with a quench solution having a concentration of amine compound in the range of from about 2 ppm to about 5,000 ppm and selected from the group of organic compounds consisting of the formula $RNH_2$ and $R_2NH$ wherein R is selected from the group consisting of alkyl groups and aryl groups for removing a significant quantity of said contaminating amounts of carbonyl compounds to produce an essentially carbonyl free, quenched hydrocarbon stream, wherein said essentially carbonyl free, quenched hydrocarbon stream is passed to caustic wash means wherein a significant amount of said contaminating amounts of acidic compounds contained in said essentially carbonyl free, quenched hydrocarbon stream is removed.

8. A process as recited in claim 7 wherein said other hydrocarbons are selected from the group consisting of ethane, propane, butane, pentane, naphtha and mixtures of any two or more thereof.

9. A process as recited in claim 8 wherein said carbonyl compounds are selected from a group consisting of aldehydes, ketones, and mixtures thereof.

10. A process as recited in claim 9 wherein said acidic compounds are selected from a group consisting of hydrogen sulfide, carbon dioxide, carbon monoxide and mixtures of any two or more thereof.

11. A process as recited in claim 10 wherein said quench solution is buffered with a pH-modifying substance, responsive to the concentration of said contaminating amounts of acidic compounds in said cracked hydrocarbons, to adjust the pH of said quench solution to a range suitable for removing a significant quantity of said contaminating amounts of carbonyl compounds in said cracked hydrocarbons.

12. A process as recited in claim 11 wherein said cracked hydrocarbons entering said quench means are at a temperature in the range of from about 300° F. to about 400° F. and wherein said essentially carbonyl free, quenched hydrocarbon stream leaves said quench means at a temperature in the range of from about 70° F. to about 90° F. and wherein the temperature of said quench solution entering said quench means is in the range of from about 65° F. to about 95° F.

13. A process as recited in claim 12 wherein within said quench means said quench solution is contacted with said cracked hydrocarbons in countercurrent fashion followed thereafter by removing the thus contacted quench solution from said quench means.

14. An ethylene cracking process comprising:

charging a hydrocarbon stream to pyrolytic cracking furnace means to thereby produce a cracked hydrocarbon stream having a concentration of carbonyl compounds and a concentration of acidic compounds;

passing said cracked hydrocarbon stream to quench means wherein said cracked hydrocarbon stream is contacted with a quench stream having a concentration of an amine compound in the range of from about 2 ppm to about 5,000 ppm and which is selected from the group of organic compounds consisting of the formula $RNH_2$ and $R_{NH}$ wherein R is selected from the group consisting of alkyl groups and aryl groups for removing a significant quantity of said concentration of carbonyl compounds from said cracked hydrocarbon stream to thereby produce a treated hydrocarbon stream; and passing said treated hydrocarbon stream to caustic wash means wherein said treated hydrocarbon stream is contacted with a caustic stream to thereby remove a significant quantity of said concentration of acidic compounds from said treated hydrocarbon stream.

15. A process as recited in claim 14, further comprising: mixing a diluent stream with said hydrocarbon stream prior to charging said hydrocarbon stream to said pyrolytic cracking furnace means.

16. A process as recited in claim 15 wherein said diluent stream is mixed with said hydrocarbon stream in an amount in the range of from about 20 weight percent to about 40 weight percent where said weight percent is defined as the ratio of the weight of the diluent stream to the total weight of the combined hydrocarbon stream and diluent stream multiplied by a factor of one hundred.

17. A process as recited in claim 16 wherein said concentration of carbonyl compounds is in the range upwardly to about 1000 ppm and said concentration of acidic compounds is in the range upwardly to about 1000 ppm.

18. A process as recited in claim 17 wherein responsive to said concentration of acidic compounds in said cracked hydrocarbon stream said quench stream is buffered with a pH-modifying substance to adjust the pH of said quench stream to a range suitable for optimum removal of said concentration of carbonyl compounds from said cracked hydrocarbons.

19. A process as recited in claim 18 wherein said hydrocarbon stream comprises hydrocarbons selected from the group consisting of ethane, propane, butane, pentane, naphtha and mixtures of any two or more thereof.

20. A process as recited in claim 19 wherein said carbonyl compounds are selected from a group consisting of aldehydes, ketones, and mixtures thereof.

21. A process as recited in claim 20 wherein said acidic compounds are selected from a group consisting of hydrogen sulfide, carbon dioxide, carbon monoxide and mixtures of any two or more thereof.

22. A method for inhibiting the formation and deposition of fouling materials during caustic washing of hydrocarbon gases, comprising:

treating hydrocarbon gases contaminated with carbonyl compounds and acidic compounds with an aqueous amine solution, wherein the amine of said aqueous amine solution is selected from the group of organic compounds consisting of the formula $RNH_2$ and RNH wherein R is selected from the group consisting of alkyl groups and aryl groups, to remove a significant amount of said carbonyl compounds to thereby produce a treated hydrocarbon stream; and contacting said treated hydrocarbon stream with a caustic stream to thereby remove a significant quantity of said acidic compounds from said treated hydrocarbon stream.

23. A method according to claim 22 wherein said hydrocarbon gases are produced by the pyrolytic cracking of other hydrocarbons.

24. A method according to claim 23 wherein said hydrocarbon gases are produced by the pyrolytic cracking of other hydrocarbons selected from a group consisting of ethane, propane, butane, pentane, naphtha and mixtures of any two or more thereof.

25. A method according to claim 24 wherein said carbonyl compounds are selected from a group consisting of aldehydes, ketones, and mixtures thereof.

26. A method according to claim 25 wherein said treating step is performed by contacting said hydrocarbon gases with said aqueous amine solution comprising water and an amine compound having a concentration range of from about 2 ppm to about 5,000 ppm.

27. A method according to claim 26 wherein said carbonyl compounds are present in said hydrocarbon gases in the concentration range of from about 1 ppm to about 1,000 ppm and wherein said treated hydrocarbon stream contains carbonyl compounds in the concentration range of from about 0.5 ppm to about 500 ppm.

28. A method according to claim 27 wherein said aqueous amine solution is buffered with a pH-modifying substance in an amount sufficient to adjust the pH of said aqueous amine solution to the range of from about 4.5 to about 7.0.

* * * * *

UNITED STATES PATENT AND TRADEMARK OFFICE

CERTIFICATE OF CORRECTION

PATENT NO. : 5,264,114

DATED : November 23, 1993

INVENTOR(S) : Fred A. Dunbar

It is certified that error appears in the above-identified patent and that said Letters Patent is hereby corrected as shown below:

Column 9, line 65, $R_{NH}$ should be ---$R_2NH$---.

Signed and Sealed this

Third Day of May, 1994

Bruce Lehman

*Attest:*

BRUCE LEHMAN

*Attesting Officer*

*Commissioner of Patents and Trademarks*